United States Patent [19]

Rosten et al.

[11] Patent Number: 4,819,829

[45] Date of Patent: Apr. 11, 1989

[54] CLOSURE FOR POURABLE MATERIALS CONTAINER

[75] Inventors: David B. Rosten, Cambridge, Minn.; William C. Perchak, Chicago, Ill.; Douglas E. Foos, Barrington, Ill.; Richard L. Partlow, Jr., Naperville, Ill.; Gary G. Buhrke, Sandwich, Ill.

[73] Assignee: Plastofilm Industries, Inc., Wheaton, Ill.

[21] Appl. No.: 182,257

[22] Filed: Apr. 15, 1988

Related U.S. Application Data

[63] Continuation-in-part of Ser. No. 122,779, Nov. 19, 1987, abandoned, which is a continuation-in-part of Ser. No. 49,125, May 12, 1987, abandoned.

[51] Int. Cl.[4] ..... B65D 43/20; B65D 51/18

[52] U.S. Cl. ..... 220/346; 220/254; 220/345; 222/544; 222/585

[58] Field of Search ..... 220/345, 346, 254; 222/544, 585, 478, 456

[56] References Cited

U.S. PATENT DOCUMENTS 4,170,724 10/1979 Waterbury ..... 220/346
4,570,817 2/1986 Hambleton et al. ..... 220/345

*Primary Examiner*—George T. Hall
*Attorney, Agent, or Firm*—Lee & Smith

[57] ABSTRACT

A closure for containers of various sizes and configurations. The closure comprises of a cover member, a flange or similar structure for attaching the cover member to a container, and a slideway formed in the cover member with a slide disposed therewithin, slideable to cover and uncover a hole formed in the cover member in the slideway. The slide is mounted in the slideway such that it normally is firmly retained within the slideway. Detents may be formed in the side of the slideway with corresponding protrusions on the other member to temporarily position the slide in one of several locations long the slideway.

20 Claims, 5 Drawing Sheets

Fig. 1.
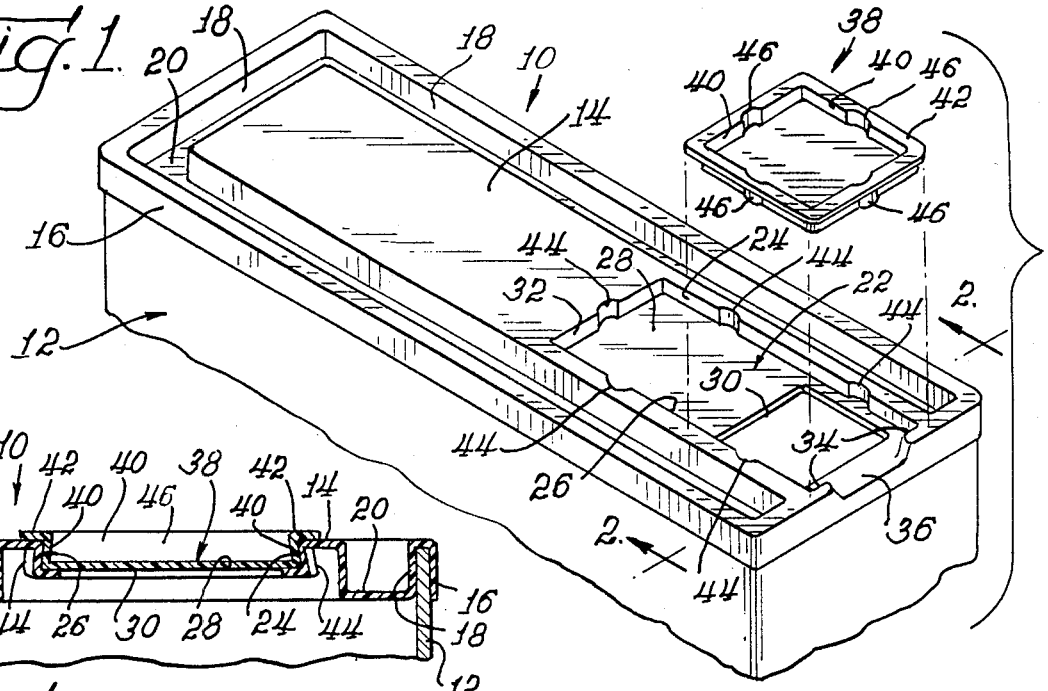
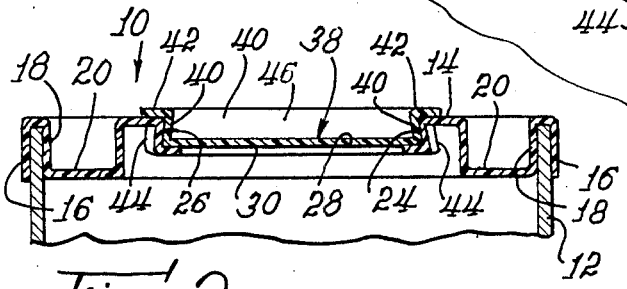
Fig. 2.
Fig. 3.
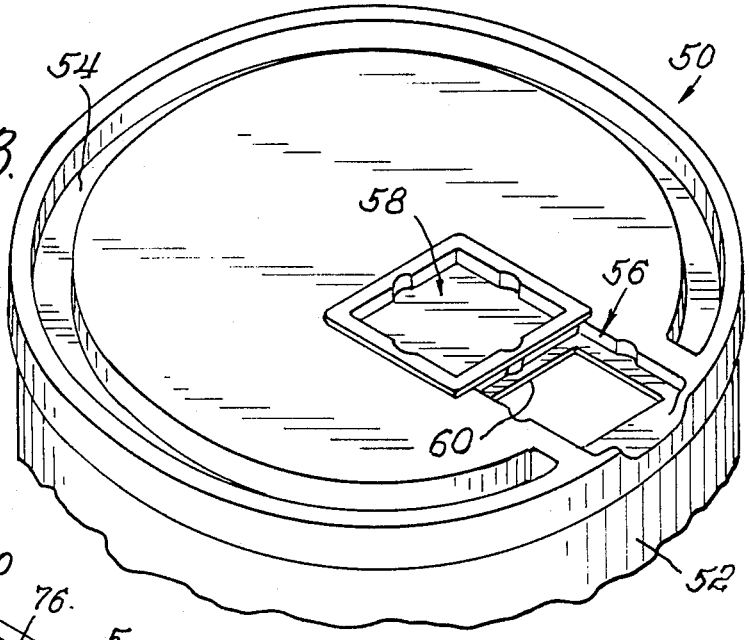
Fig. 4.
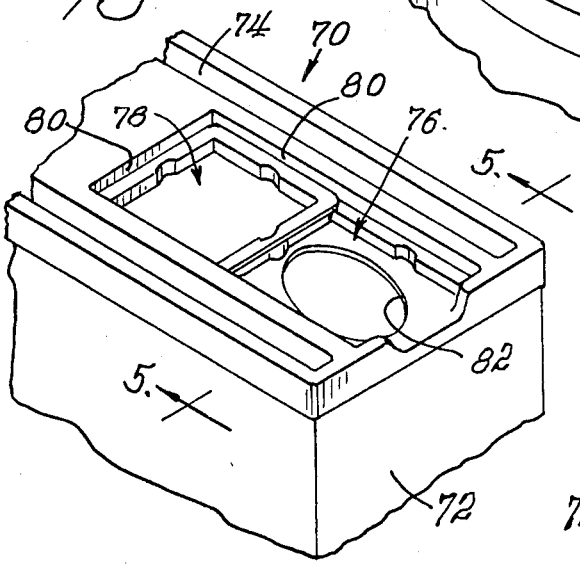
Fig. 5.
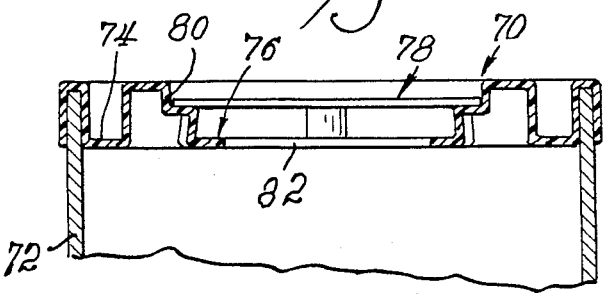

CLOSURE FOR POURABLE MATERIALS CONTAINER

RELATED APPLICATION

This application is a continuation-in-part of copending U.S. patent application Ser. No. 122,779, filed Nov. 19, 1987, which in turn is a continuation-in-part of copending U.S. patent application Ser. No. 49,125, filed May 12, 1987 and now abandoned.

BACKGROUND OF THE INVENTION

This invention relates to containers for pourable materials, and in particular to a closure for such a container formed to firmly retain the contents yet readily openable by slide means to permit pouring of the contents or any portion thereof from container.

Immense quantities of pourable consumer products, such as detergent granules, powders or liquids, foods such as sugars, macaroni and other pastas, cereals including prepared breakfast foods and many other items, are produced, packaged, marketed and consumed every day. A common package is a cardboard box having a top with some provision for opening so that the box can be tipped and the contents poured out for use. Specific examples are granular detergents packed in cardboard boxes having a partially cut out area in or near the top which can be forced in by a finger or thumb to provide an opening, and prepared breakfast foods that have an air tight inner bag and a box closed by flaps that are glued together. The latter can be more or less closed by folding over the top of the opened bag and then bringing together the flaps which are usually provided with a tongue and slit for holding them together. While huge quantities of such packages are sold, most are quite deficient in that once they are opened, they cannot be satisfactory closed. The granular detergents can spill from the opening and the flaps of cereal boxes are frequently torn in the initial opening of the boxes, preventing proper closure. Since similar products sold by different manufacturers are highly competitive, cost is definitely a limiting factor insofar as package design and construction are concerned, and since the packages normally are thrown away when the contents have been used.

SUMMARY OF THE INVENTION

The present invention provides an improved form of closure for packages for pourable materials of almost any kind. In one form, the closure is a part separate from the body of a package, but it can be easily secured to the package and, of great importance, includes means for opening the package so that the contents can be partially poured out and the package then reclosed for continued storage of the contents for future use.

In accordance with the invention, the closure for the container comprises a generally planar cover member, means for attaching the cover member to the top of a container, a slideway formed in the cover member which extends inwardly generally from one edge thereof, and a side disposed in the slideway. The slideway extends for at least a predetermined length, and includes spaced, parallel side walls, a floor extending between the side walls, and an opening in the floor to permit removal of the contents of the container through the opening. The slide has a length less than the predetermined length of the slideway, and is mounted in the slideway for sliding movement along the length of the slideway, the mounting structure of the slide being such that the slide is retained in the slideway.

The slide may have one or more handles to facilitate movement of the slide along the slideway. In order to inhibit inadvertent removal of the slide from the slideway, a stop is provided at the forward end of the slideway at the edge of the box cover. The stop includes a recess aligned with the floor of the slideway and shaped so that the contents of the container can be removed without interference.

Preferably, the slide/slideway combination is provided with means for temporary latching the slide in the slideway. In accordance with one form of the invention, such means comprises at least one detent in at least one of the sides of the slideway and a corresponding aligned protrusion or other mating formation on the slide. When the slide includes a handle, the protrusion may be located on the handle. In accordance with another form of the invention, such means comprises a detent on the slide and at least one corresponding aligned protrusion on at least one of the sides of the slideway.

In order that the slide not be inadvertently removed from the slideway, in accordance with one form of the invention, the side walls of the slideway are sloped inwardly toward one another from the floor of the slideway. In this form of the invention, the slide has sides engaging the side walls which are also inclined inwardly toward one another conforming to the slide walls. In accordance with a second form of the invention, retention of the slide within the slideway is accomplished by an indented channel formed in each side wall adjacent the slideway floor, with the slide including a flat bottom portion extending into the channels. The bottom portion of the slide has a width greater than the spacing of the side walls so that the slide is securely but slidably retained in the slideway within the channels.

The size and shape of the opening in the cover member may be dictated by custom or by the nature of the contents within the container. Typically, the opening extends for no greater than one-half the length of the slideway, while the length of the slide is at least half the length of the slideway. The slide may therefore fully cover the opening in one position and may be slid away from the opening to a second position to allow the contents of the container to be poured out.

Assembly of the slide within the slideway may be somewhat cumbersome in some forms of the invention. Accordingly, the invention includes means for facilitating ready insertion of the slide within the slideway. That means comprises a ramp formed in each side wall of the slideway, each ramp being inclined upwardly from the floor of the slideway. The ramps are opposite one another so that the slide may be guided easily into the slideway. If necessary, a sloped approach is formed in the cover member leading to and aligned with the ramps.

The closure may comprise an entire top for a container, or may occupy only a portion of the top or one of the sides of the container, if the contents are intended to be poured from other than the top. When the closure comprises an insert for the top or sides of the container, the closure also includes a peripheral flange which may be adhesively or otherwise affixed to the surrounding structure of the container.

BRIEF DESCRIPTION OF THE DRAWINGS

The invention is described in greater detail in the following description of examples embodying the best mode of the invention, taken in conjunction with the drawing figures, in which:

FIG. 1 is a perspective view of one form of the closure according to the invention, partially exploded to show the interrelationship of elements.

FIG. 2 is an enlarged cross-sectional view taken along lines 2—2 of FIG. 1.

FIG. 3 is a perspective view of a second form of the invention, being circular in configuration and having a slideway structure identical to that of FIG. 1.

FIG. 4 is a partial perspective view of another form of the invention having the slideway structure indented slightly within the closure according to the invention.

FIG. 5 is an enlarged cross-sectional view taken along lines 5—5 of FIG. 4.

DESCRIPTION OF EXAMPLES EMBODYING THE BEST MODE OF THE INVENTION

Figure 6:
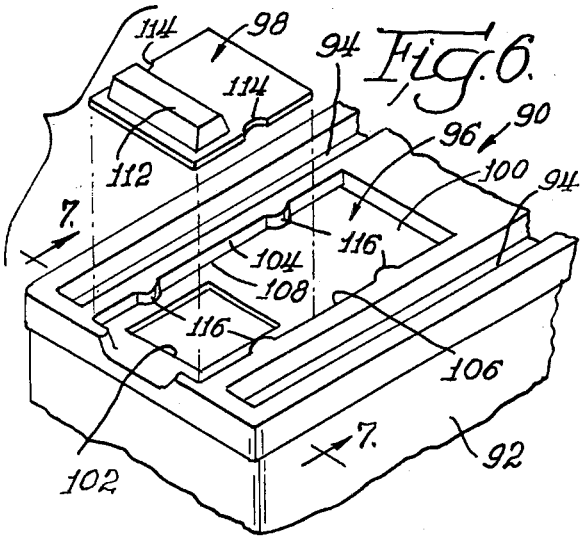
FIG. 6 is a partial perspective of yet another form of the invention, exploded to illustrate interrelationship of parts.

The present invention provides an improved form of closure for pourable material packages of any size or configuration. Typically, the closure is a separate part from the rest of the package and can easily be secured as a complete top or an insert within an aperture in the container. As described in greater detail below, the closure includes various forms of means for opening the package so that the contents can be partially or completely poured out and the package then reclosed for continued storage of the remainder of the contents for future use.

The closure according to the invention can be produced at very low cost by thermoforming plastic film to the configuration desired. The closure is configured and dimensioned to either fit over the upper marginal portions of the container to which it is attached or to fit within an aperture in the container, and is normally glued in place.

Turning to FIGS. 1 and 2, illustrated is a closure 10 according to the invention affixed to a rectangular container 12. The closure 10 consists of a generally planar cover portion 14 and includes a peripheral side flange 16 extending about the entire closure 10 and telescoping over the top edge portions of the container 12, as best shown in FIG. 2. For strength and rigidity of the plastic closure 10, the peripheral flange 16 is connected to a downwardly extending wall 18, the flange 16 and wall 18 sandwiching the container between them and forming an inverted U-shaped groove for the reception of the top portions of the container 12. By application of glue to the inner sections of that U-shaped groove and/or the container 12, the closure 10 may be permanently affixed to the container 12.

For added strength and rigidity of the plastic closure 10, an additional groove 20 is formed immediately inwardly adjacent the downwardly depending side wall 18.

A slideway 22 is formed in the cover portion 14, extending to one of the edges of the closure 10, as shown in FIG. 1. The slideway 22 includes spaced, parallel side walls 24 and 26, a floor 28 extending between the sidewalls, and an access opening 30 in the floor 28 to permit removal of the contents of the container 12 through the opening 30, normally by inverting the container 12. The slideway 22 terminates at a back wall 32 and a front stop 34 including a recess 36 which is cut away to the plane of the floor 28 so that material in the container 12 can be poured out without interference.

A slide 38, which may be thermoformed from plastic film or may be injection molded, is located within the slideway 22. The slide 38 has raised marginal sides 40 and, for improving the strength and rigidity of the slide 38, a peripheral outwardly-extending flange 42. As illustrated in FIG. 1, the dimensions of the slide 38 are sufficient so that the slide 38 may entirely cover the access opening 30 when sealing of the container 12 is desired, and the length of the slideway 22 is sufficient so that the slide 38 may be withdrawn rearwardly within the slideway 22 so that the access opening 30 is fully exposed.

During normal use of the closure 10, the slide 38 must be securely retained within the slideway 22. As shown in FIG. 2, the side walls 24 and 26 are formed with a reverse draft so that the walls slope inwardly as they rise from the floor 28. The sides 40 of the slide 38 are correspondingly inclined inwardly and the width of the slide 38 is such that it is retained snugly between the side walls 24 and 26 within the slideway 22.

It is often desired to temporarily locate the slide 38 at a particular location in the slideway 22. The side walls 24 and 26 of the slideway 22 therefore includes a series of detents 44. Corresponding protrusions 46 are formed in the sides 40 of the slide 38. As the slide 38 traverses the slideway 22, the protrusions 46 engage the detents 44 forming a temporary "lock" at the point of engagement. As shown in FIG. 1, the detents 44 are formed such that the slide 38 may be locked in position directly above the access opening 30 or, when slid rearwardly within the slideway 22, to a position where the opening 30 is fully uncovered.

The slide 38 is illustrated with protrusions 46 formed in all four sides 40. Obviously, only two of the protrusions 46 on opposite sides of the slide 38 will be functional to engage the detents 44 at any one time. For manufacturing expediency, it is preferred that the slide 38 is square, and thus the protrusions 46 are formed in all sides so that the slide may be readily and rapidly installed within the slideway 22 without concern for the proper orientation of the slide 38. Also, a detent 46 is formed in the backwall 32 of the slideway 22 if necessary to accommodate the slide 38 in its rearward excursion when uncovering the access opening 30. Should the slideway 22 be sufficiently long, the detent 46 in the back wall 32 obviously would be unnecessary.

FIG. 3 illustrates a second form of the invention, comprising a circular closure 50 applied to a circular container 52. The closure 50 is essentially identical to the closure 10 of FIG. 1, the only difference being that the closure 50 is circular. Similar to the closure 10, the closure 50 includes a groove 54 for strengthening purposes, and includes a slideway 56 engaged by a slide 58. The slideway 56 and slide 58 are identical to the respective slideway 22 and slide 38 of the embodiment of FIGS. 1 and 2, and are therefore not described in further detail, reference to the description above being adequate for the nature and function of the engaged slide 58 and slideway 56. A square access opening 60 is provided, identical to the access opening 30 of the embodiment of FIGS. 1 and 2.

FIGS. 4 and 5 illustrate another form of the invention, quite similar to the forms shown in FIGS. 1 and 2, and having a closure 70 applied to a container 72. Similar to the embodiment of FIGS. 1 and 2, the closure 70 includes a strengthening groove 74 and a slideway 76 engaged by a slide 78. In this embodiment of the invention, however, the slideway 76 is located within a recess 80 formed in the closure 70. The slide 78 is therefore located beneath the upper planar surface of the closure 70, protecting the slide 78 somewhat from damage or inadvertent removal from the slideway 76. Otherwise, the combination of the slide 78 and slideway 76 is identical to that of the respective slide 38 and slideway 22 of FIGS. 1 and 2, the description of which may be consulted for greater detail.

In the embodiment of FIGS. 4 and 5, an access opening 82 is provided of a generally elliptical shape. The slide 78 and access opening 82 are sized so that the slide 78, when closed across the access opening 82, completely covers the access opening and, when slid rearwardly within the slideway 76, is withdrawn completely to provide full access to the opening 82, as shown in FIG. 4.

Figure 7:
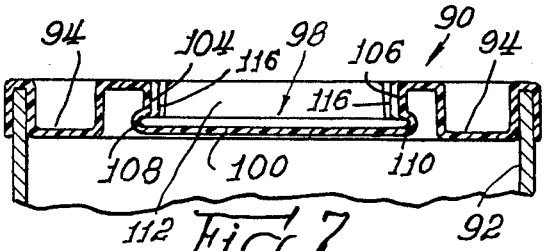
FIG. 7 is an enlarged, assembled cross-sectional view taken along lines 7—7 of FIG. 6.

Another form of the invention is illustrated in FIGS. 6 and 7. Similar to the previous forms of invention, a closure 90 is affixed to the upper marginal portion of a container 92. For strengthening purposes, the closure 90 includes a peripheral groove 94 and includes a slideway 96 which is engaged by a slide 98.

Similar to the other forms of the invention described above, the slideway 96 includes a floor 100 having an access opening 102. The slideway 96 also includes opposite parallel side walls 104 and 106 which, as best shown in FIG. 7, are essentially vertical. Respective indented channels 108 and 110 are formed in the side walls 104 and 106 adjacent the floor 100. The slide 98 is sufficiently wide so that the slide extends into the respective channels 108 and 110. As shown in FIG. 7, the slide 98 is wider than the spacing between the slide walls 104 and 106 so that the slide 98, when installed within the slideway 96, is retained securely in place.

The slide 98 includes an internal raised handle 112 with which to move the slide to and fro within the slideway 96. In a similar fashion to the previously described forms of the invention, the slide 98 is formed with opposite detents 114 which engage corresponding protrusions 116 formed in the side walls 104 and 106 of the slideway 96. The positioning of the detents 114 and protrusions 116 is such that the slide 98 may be temporarily retained in place covering the access opening 102 or slid rearwardly within the slideway 96 to fully uncover the access opening 102.

Figure 8:
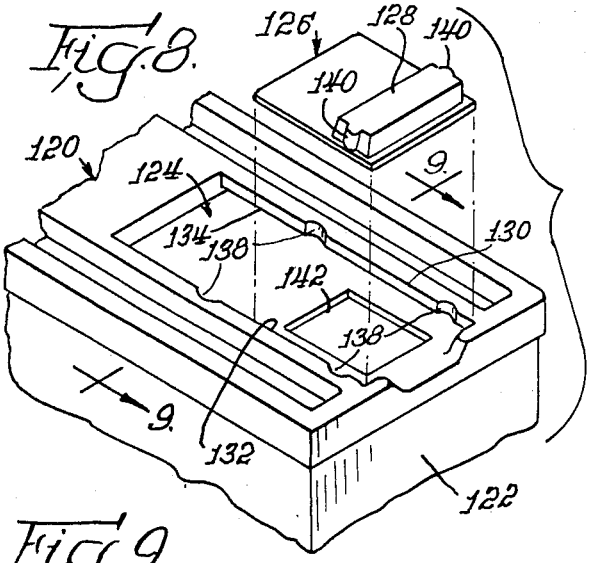
FIG. 8 is an exploded perspective view of still another form of the invention.
Figure 9:
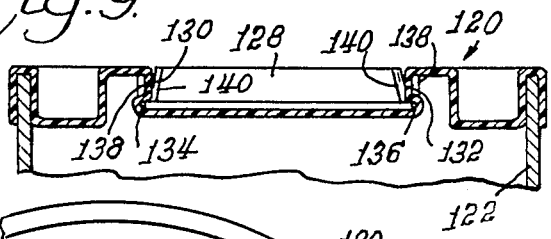
FIG. 9 is an enlarged, assembled cross-sectional view taken along lines 9—9 of FIG. 8.

In the form of the invention illustrated in FIGS. 8 and 9, a closure 120 is shown secured to a container 122. The closure 120 includes an integral slideway 124 which is engaged by a slide 126 having an integral handle 128. The slideway 124 is formed with vertical walls 130 and 132 having respective indented channels 134 and 136 as shown in FIG. 9. Engagement of the slide 126 within the slideway 124 is identical to that described above with respect to FIGS. 6 and 7. In this embodiment, however, for temporary positioning of the side 126, the slide walls 130 and 132 are formed with a series of detents 138 and the handle 126 is formed with corresponding protrusions 140. The detents 138 are located so that the slide 126 may be temporarily positioned in a first location immediately above an access opening 142 and in a second location rearwardly within the slideway 124 to fully uncover the access opening 142.

Figure 10:
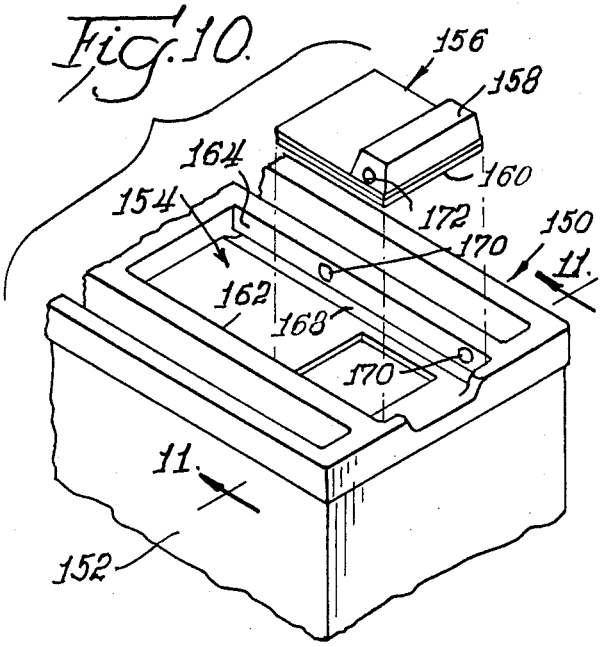
FIG. 10 is an exploded perspective view of another form of the invention.
Figure 11:
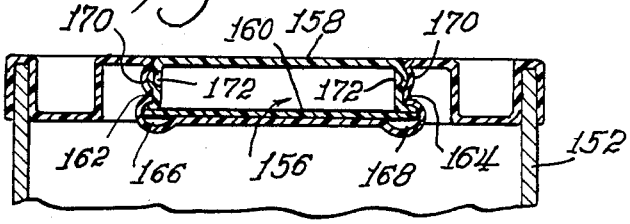
FIG. 11 is an enlarged cross-sectional view taken along lines 11—11 of FIG. 10.

FIGS. 10 and 11 illustrate yet another form of the invention quite similar to that illustrated in FIGS. 8 and 9. In this form of the invention, as in all other forms of the invention, a closure 150 is affixed to a container 152. The closure 150 includes a slideway 154 which is engaged by a slide 156 having an integral handle 158. As explained above, the slide 156 is preferably thermoformed from plastic. The under side of the handle 158 would normally therefore by hollow. To prevent the contents of the container 152 from becoming lodged within the underside of the handle 158, the slide 156 is provided with a flat bottom layer 160 which is appropriately affixed to the underside of the slide 156.

The slideway 154 has parallel, vertical opposed side walls 162 and 164 each of which includes an idented channel 166 and 168. In an identical fashion to that described above with respect to FIGS. 6 through 9, the width of the slide 156 is sufficient so that the slide 156 is engaged within the channels 166 and 168. For manufacturing purposes, it may be necessary to form the channels 166 and 168 slightly larger than the respective channels illustrated in FIGS. 6 through 9. Larger channels 166 and 168 are shown in the embodiment of FIGS. 10 and 11, it being evident that the larger channels will neither interfere with the function of the slide 156 within the slideway 154 nor the security of the retention of the slide 156 within the slideway 154.

For temporary positioning of the slide 156 within the slideway 154, the vertical side walls 162 and 164 are provided with a series of detents 170. Corresponding protrusions 172 are formed in the handle 158 of the slide 156. The slide 156 may therefore be retained in one location, closed across access opening 174, or in a second orientation withdrawn sufficiently so that the access opening 174 is fully uncovered.

Figure 12:
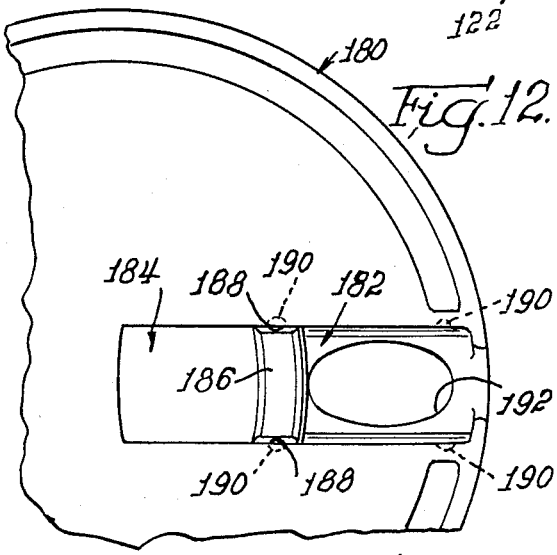
FIG. 12 is a partial top plan view of still another form of the invention when formed to be applied to a circular container.

FIG. 12 illustrates yet another form of the invention, essentially identical to that illustrated in FIGS. 10 and 11, but in a circular form and having an elliptical access opening. As illustrated, a closure 180 is provided with a slideway 182 into which a slide 184 has been inserted. The slide 184 includes a raised handle 186 having extending protrusions 188 which engage respective detents 190 formed in the sidewalls of the slideway 182. In this embodiment, similar to the embodiment of FIGS. 4 and 5, an elliptical access opening 192 is formed in the slideway 182. The nature and functioning of the slide 184 and slideway 182 are identical to the respective slide 156 and slideway 154 of the embodiment of FIGS. 10 and 11, and therefore are not described in greater detail. As illustrated, because the closure 180 is circular, the handle 186 can be curved to conform to the circular configuration.

Figure 13:
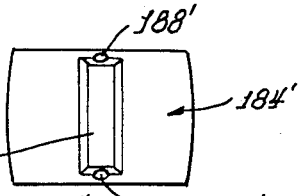
FIG. 13 is a top plan view of another form of slide according to the invention.
Figure 14:
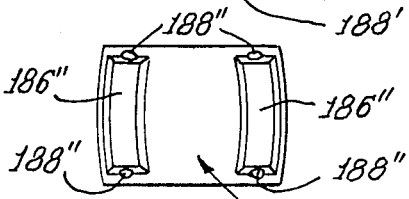
FIG. 14 is a top plan view of still another form of slide according to the invention.

FIGS. 13 and 14 illustrate alternative embodiments of the slide 184. In FIG. 13, the slide 184' includes a central handle 186' having opposite protrusions 188' for engagement of corresponding detents 190 in the slideway 182 (FIG. 12). Obviously, when using the slide 184', the detents 190 would need to be relocated commensurate with the relocation of the handle 186' on the slide 184'. In FIG. 14, the slide 184" is provided with a pair of handles 186" at opposite ends thereof. In this form of the invention, because of the provision of a pair of handles 186" having respective protrusions 188", depending on the size of the opening 192 in the closure 180, a single pair of detents 190, appropriately positioned in the slideway 182, may be the only detents necessary to temporarily retain the slide 184" in the desired of two positions.

FIGS. 15 through 18 illustrate another form of the invention, essentially identical to that illustrated in FIGS. 10 and 11, but with the addition of a ramp arrangement to facilitate initial assembly of the illustrated closure 200. As illustrated, the closure 200 is provided with a slideway 202 into which a slide 204 may be inserted. The slide 204 includes a raised handle 206 having extending protrusions 208 which engage respective detents 210 formed in the sidewalls 203 of the slideway 202. An access opening 212 is provided in the slideway 202 to permit the contents of any container to which the closure 200 is affixed to be readily poured out. The nature and functioning of the slide 204 and the slideway 202 are identical to the respective slide 156 and slideway 154 of the embodiment of FIGS. 10 and 11, and therefore are not described in greater detail.

Due to the configuration and dimensions of the slide 204 and the slideway 202, it is somewhat difficult to assemble the slide within the slideway. More particularly, because the normal distance between sidewalls 203 must be less than the lateral dimension of slide 204 in order for the slide 204 to be retained within indented channels 220 and 222, the slide must be distorted to pass between the sidewalls into the channels. To render such distortion unnecessary and facilitate assembly, rearward indented portions 213 are formed in the sidewalls 203 to provide a distance between such portions equal to or slightly greater than the lateral dimension of the slide 204 so that the latter may easily pass down into channels 220 and 222. To guide the slide 204 into place, and to retain the channel configuration, opposite ramps 214 are provided in sidewalls 203 as shown in the drawing, only one ramp 214 being illustrated in detail in FIG. 15.

Figure 15:
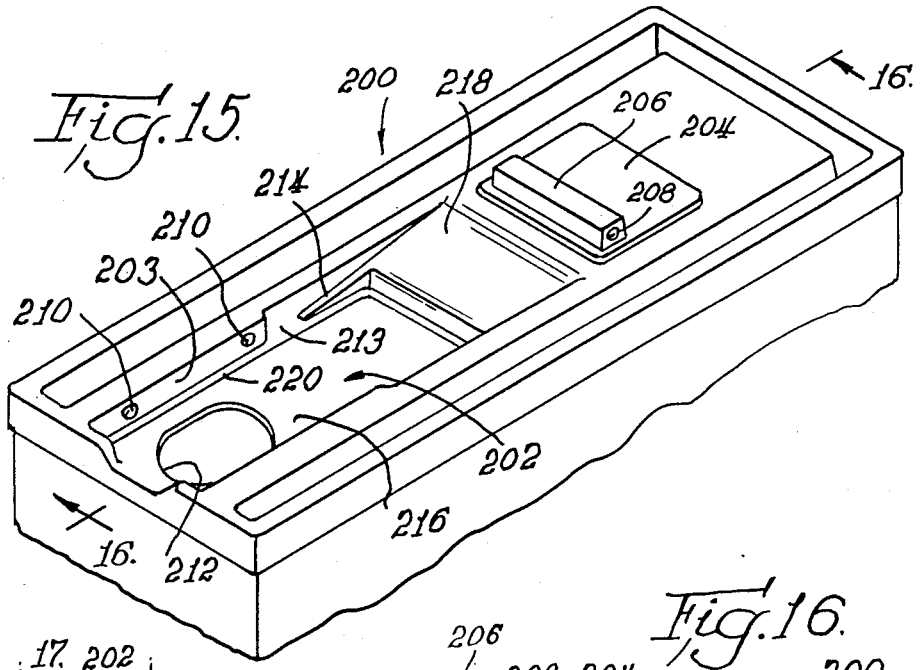
FIG. 15 is a perspective view of yet another form of the invention including means for facilitating insertion of the slide within the slideway.
Figure 16:
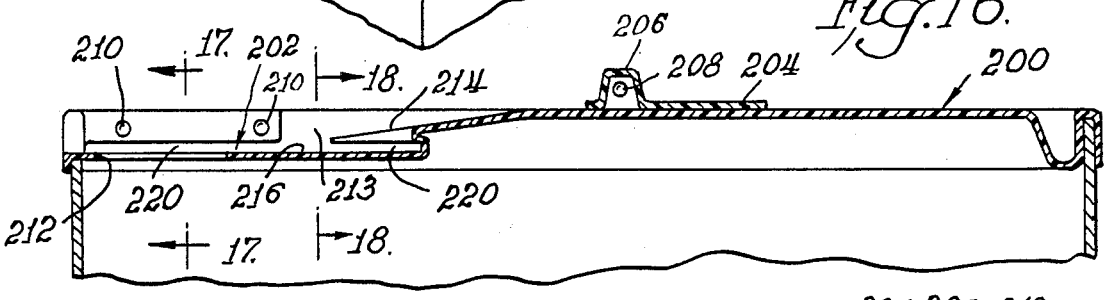
FIG. 16 is an enlarged cross-sectional view taken along lines 16—16 of FIG. 15.
Figure 17:
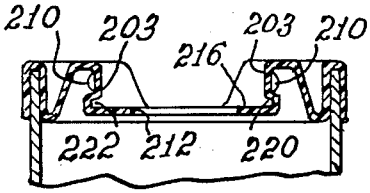
FIG. 17 is a cross-sectional view taken along lines 17—17 of FIG. 16.
Figure 18:
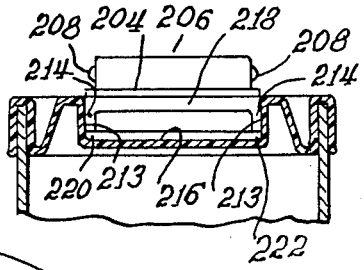
FIG. 18 is a cross-sectional view taken along lines 18—18 of FIG. 16.

As illustrated in FIGS. 15 and 16, each of the ramps 214 is inclined upwardly from the floor 216 of the slideway 202 until the upper surface of the closure 200 has been reached. If the slope of the ramps is such that they extend beyond the rear wall of slideway 202 before reaching the upper surface of closure 200 or if the depth of the slideway 202 within the closure 200 requires the ramps to extend beyond the rear wall of the slideway 202, an inclined approach 218 may be provided leading to and aligned with the ramps 214.

To assemble the slide 204 within the slideway 202, the slide is positioned as illustrated in FIG. 15. The slide is then passed down the approach 218, down the ramps 214 and is engaged within the opposite channels 220 and 222 of the slideway 202. The slide 204 may then be slid to and fro within the slideway 202 as in the previous forms of the invention. The slide 204 does not inadvertently reengage the ramps 214 and pass out of the slideway because of continuity of the channels 220 and 222 and the angular disposition of the ramps with regard to the channels.

Figure 19:
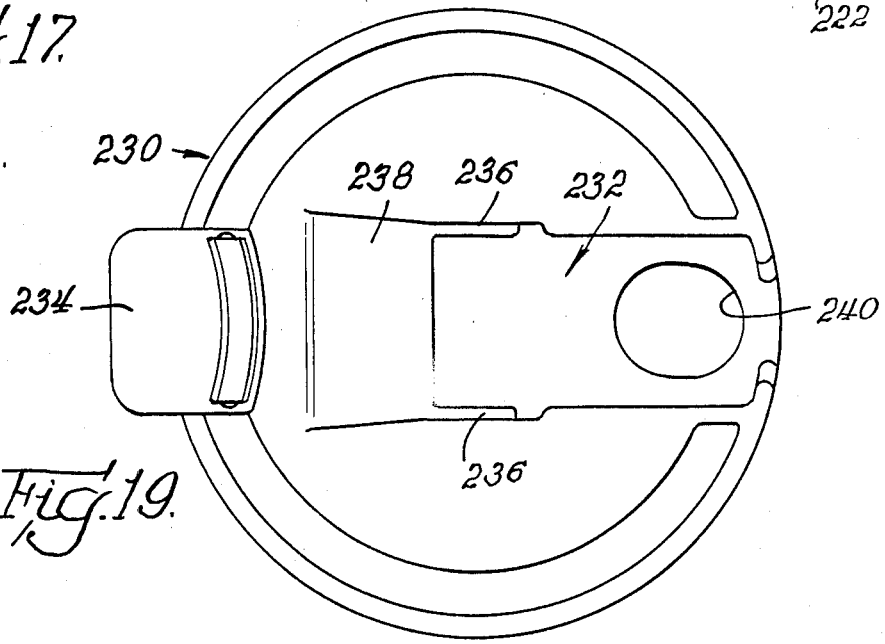
FIG. 19 is a top plan view of a form of the invention similar to that of FIG. 15, but when applied to a circular container.

Another form of the invention is illustrated in FIG. 19. The closure 230 illustrated is essentially identical to that illustrated in FIGS. 15 through 18, except that the closure 230 is circular. The closure 230 is provided with a slideway 232 in which a slide 234 may be inserted. The slide 234 is installed within the slideway 232 by means of inclined opposite ramps 236 leading from an inclined approach 238. As illustrated in FIG. 19, the approach 238 may be flared slightly as the distance from the slideway 232 increases in order to readily facilitate proper insertion and alignment of the slide 234 as it is installed within the slideway 232. Again, the approach 238 may be omitted if the ramps 236 are sufficiently steep and/or the depth of the slideway 232 is sufficiently shallow so that the necessity of the approach 238 is eliminated. Contents of any container to which the closure 230 is attached may be poured out through an access opening 240.

Figure 20:
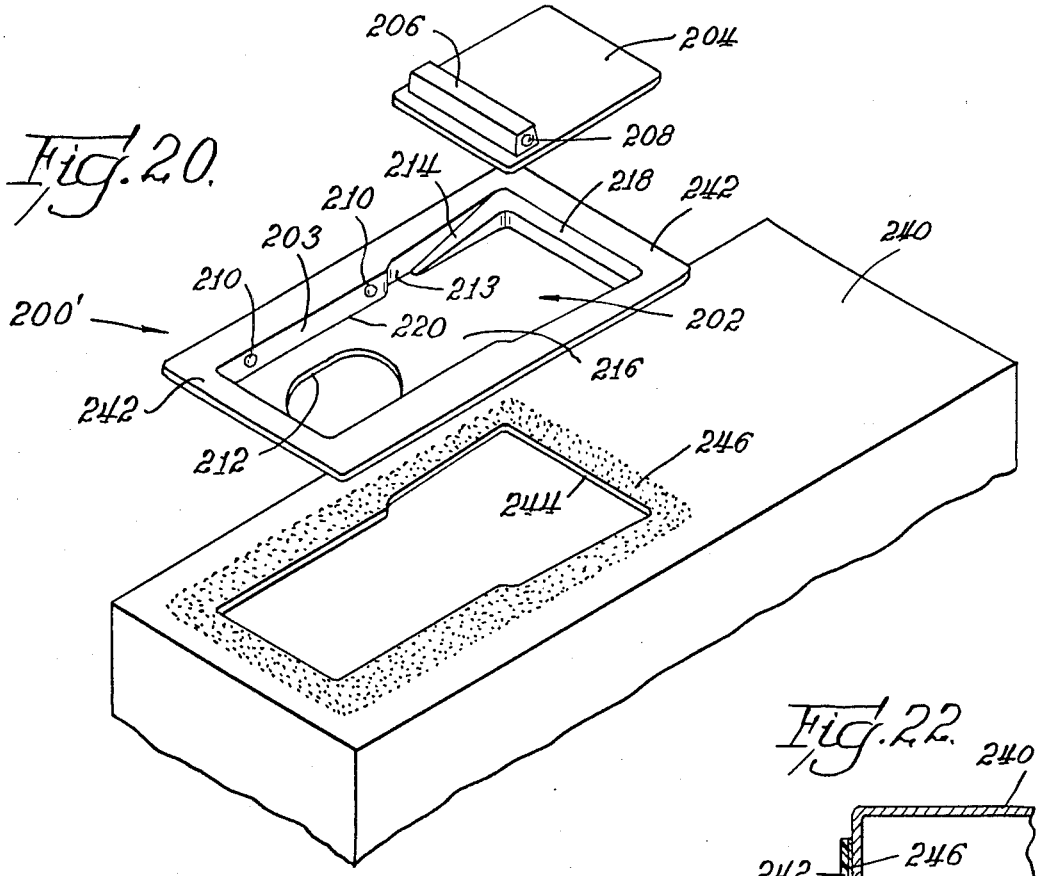
FIG. 20 is an exploded perspective view of still another form of the invention where the closure of the invention is installed within an aperture in a container.
Figure 21:
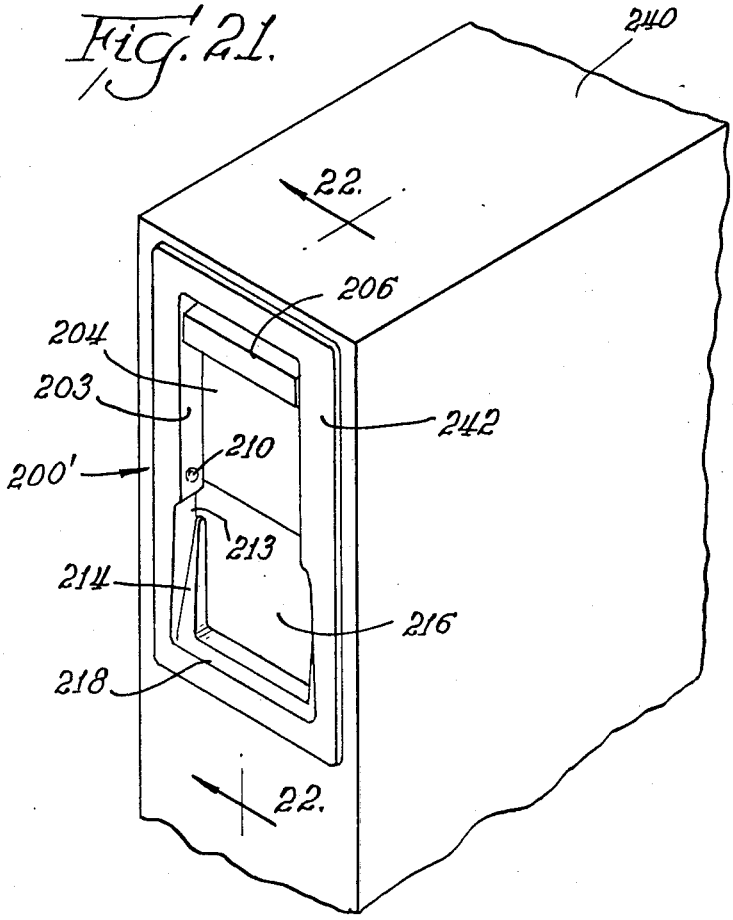
FIG. 21 is a perspective view of the closure of FIG. 20 when installed within the side of a container.
Figure 22:
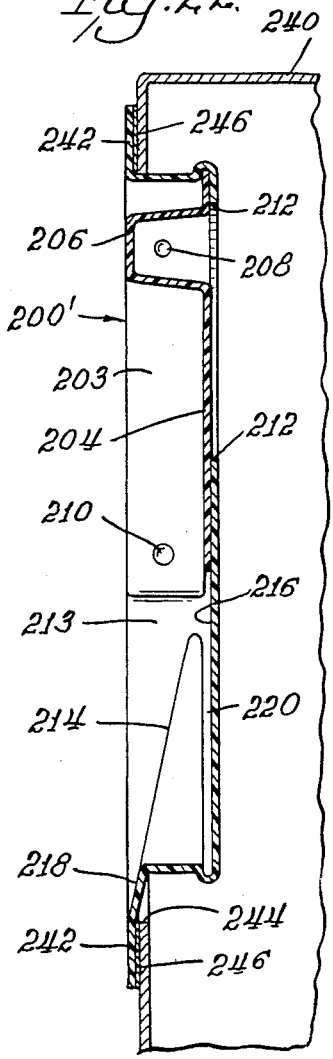
FIG. 22 is an enlarged cross sectional illustration taken along lines 22—22 of FIG. 21.

FIGS. 20 through 22 illustrate another form of the invention which is essentially identical to the form of the invention shown in FIGS. 15 through 18, the primary difference being that the closure 200' of FIGS. 20 through 22 is installed within an aperture rather than occupying the entire top of a container 240. With the exception of the differences explained below, therefore, the closure 200' is identical to the closure 200 and like elements bear identical reference numerals. Their form and function are the same as described above, and therefore will not be described again.

The closure 200' includes a flange 242 which extends about the entire periphery thereof. The container 240 includes an aperture 244 shaped to accommodate the closure 200'. The aperture 244 can be formed to closely match the shape of the closure 200', as illustrated, or can be rectangular. The closure 200' is secured to the container 240 by means of a layer of adhesive 246 which may either be applied about the margin of the aperture 244, or to the underside of the flange 242, or both.

The closure 200' is shown in FIGS. 21 and 22 installed in one of the sides of the container 240. As best shown in FIG. 22, the closure 200' is installed so that the flange 242 ends slightly spaced from the top of the container 240 so that the flange 242 is less susceptible to being inadvertently caught and pulled away from the container 240 during shipping of the container.

Figure 23:
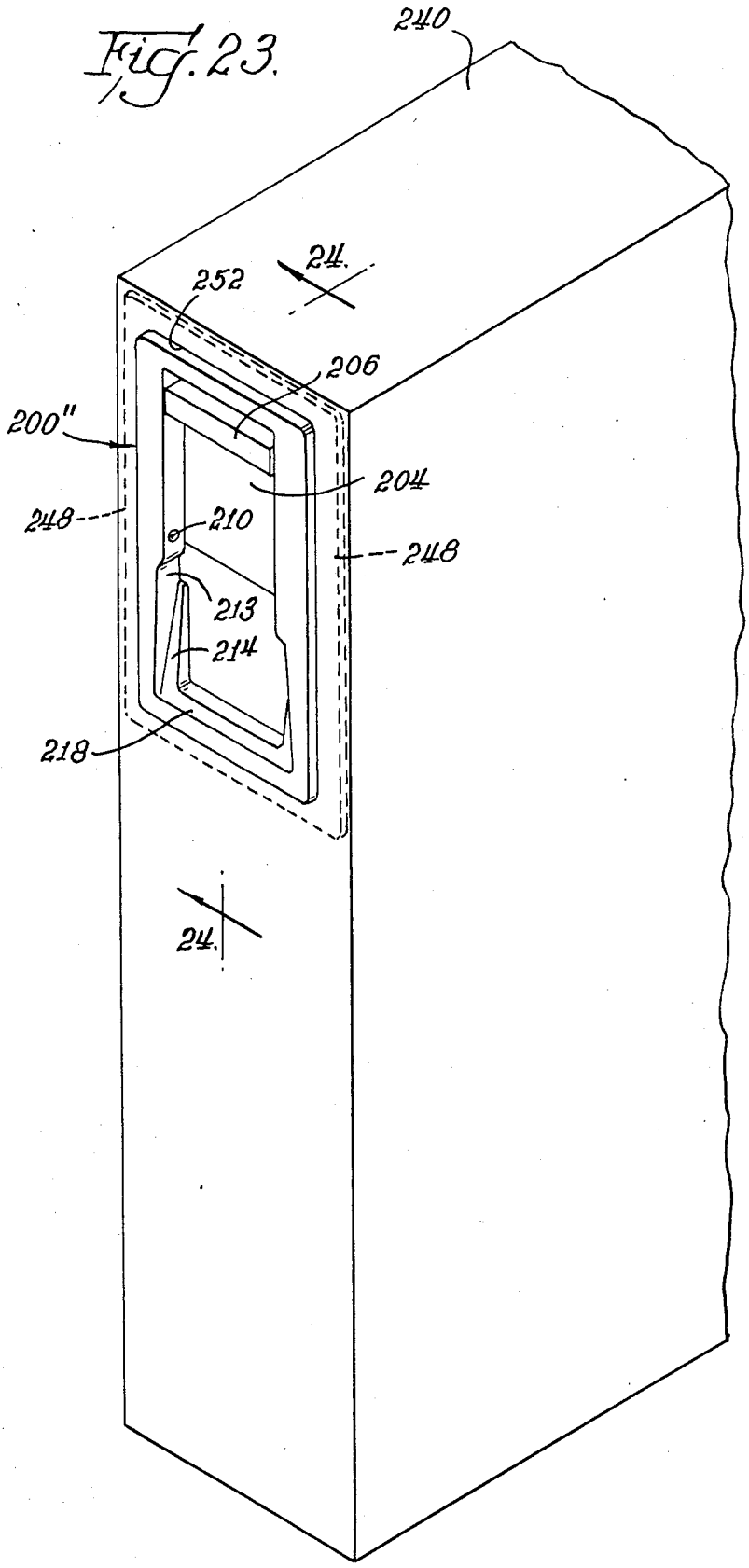
FIG. 23 is a perspective view of a final form of the invention, again installed within an aperture in the side of a container.
Figure 24:
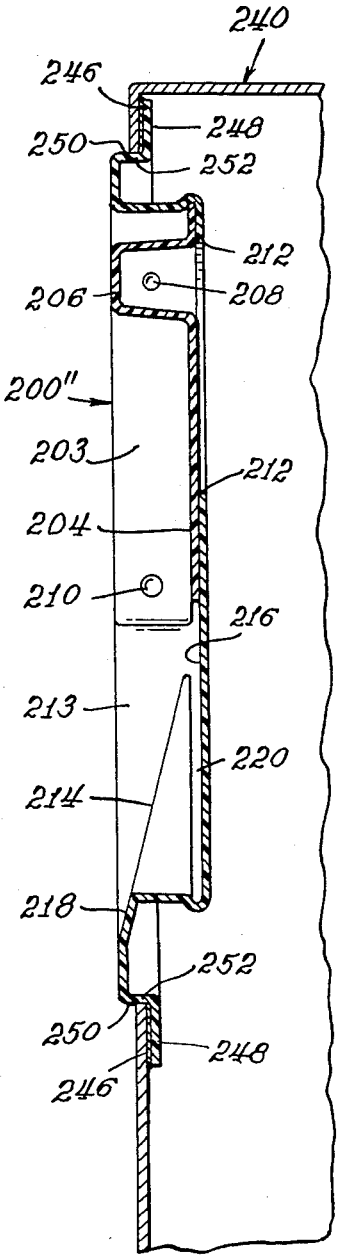
FIG. 24 is an enlarged cross sectional illustration taken along lines 24—24 of FIG. 23.

A final form of the invention is illustrated in FIGS. 23 and 24. Again, the closure 200″ is essentially identical to that illustrated in FIGS. 15 through 18, and therefore like elements bear identical reference numerals. The description above of FIGS. 15 through 18 should be consulted for greater detail for these elements.

The closure 200″ differs from the closure 200′ in that although the closure 200″ includes a peripheral flange 248, that flange is depressed slightly about the periphery of the closure 200″ in a recess 250 which is best shown in the cross sectional view of FIG. 24. As illustrated, the closure 200″ is intended to be installed from the interior of the container 240 through a rectangular aperture 252 which is shaped to permit all but the flange 248 to protrude therethrough.

ACHIEVEMENTS

The invention provides a substantially improved form of closure for pourable material packages including such diverse materials as powders, granules, flake-form prepared breakfast foods, and liquids. It avoids the problems of common packages which cannot be satisfactorily closed and which often have closure structures that are frequently damaged in the initial opening of the box. The components of the closure according to the invention can be quite simply thermoformed from sheet plastic, or, if greater strength is desired, either the closure or the slide can be injection molded.

The slide/slideway structure provides easy opening and closing of a container. The detents and corresponding protrusions assure that the slide can be retained temporarily in place, while being held securely within the slideway due to either the reverse draft of the slidewalls of the slideway or the slideway grooves, depending on the form of the invention utilized. The access opening can be any size or shape depending on the type of contents within the container to which the closure is applied. Larger openings may be required for prepared breakfast cereals for example. While elliptical and square shapes have been shown, round openings and other configurations can be employed as well.

The slide is readily assembled within the slideway formed in the closure, and in the embodiment of FIGS. 1 through 5, care need not be taken to properly orient the slide because the slide is symmetrical and therefore will engage the slideway no matter how it is inserted. The provision of the ramps illustrated in FIGS. 15 through 19 facilitate insertion of the slide within the slideway, yet prevent inadvertent removal of the slide from the slideway.

The closure of the invention may comprise an entire top for a container, or may be an insert applied to the exterior or interior of a container, as desired. The closure may be located at the top of a container, taking the place of typical fold or insert type closures, or may be located on one of the sides of the container in place of a pouring hole or spout. The versatility of the closure according to the invention permits its utilization in practically any container where the contents must be expelled by pouring.

Various changes may be made in the invention without departing from the spirit thereof or scope of the following claims.

What is claimed is:

1. A closure for a container, comprising a. generally planar cover member, b. means for attaching said cover member to a container, c. a slideway formed in the cover member and extending generally from one edge thereof, said slideway extending at least a predetermined length and including i. spaced, parallel sidewalls, ii. a floor extending between said sidewalls, and iii. an opening in the floor to permit removal of the contents through the opening, d. a slide disposed in said slideway, said slide having a length less than said predetermined length, e. means mounting said slide in said slideway for sliding movement along the length of said slideway, said mounting means also retaining said slide in said slideway, and f. means formed in said cover member for facilitating insertion of said slide within said slideway, said facilitating means comprising an indented portion formed in each said sidewall, said indented portions being opposite one another and being separated a distance at least equal to a lateral dimension of said slide.

2. A closure according to claim 1 including handle means on said slide to facilitate movement of said slide.

3. A closure according to claim 1 including stop means to prevent movement of said slide beyond said slideway.

4. A closure according to claim 3 in which said stop means is located in said one edge of said cover member at one end of said slideway.

5. A closure according to claim 4 in which said stop means includes a recess, said recess being aligned generally with said floor.

6. A closure according to claim 1 including means for temporarily positioning said slide at a desired location in said slideway.

7. A closure according to claim 6 in which said means for temporarily positioning comprises at least one detent in at least one of said sidewalls and a corresponding aligned protrusion on said slide.

8. A closure according to claim 7 in which said slide includes a handle, said protrusion being located on said handle.

9. A closure according to claim 6 in which said means for temporarily positioning comprises a detent on said slide and at least one corresponding aligned protrusion in at least one of said side walls.

10. A closure according to claim 1 in which said mounting means comprises said sidewalls being sloped inwardly toward one another from said floor, and said slide having sides engaging said side walls and being inclined inwardly toward one another conforming to said side walls.

11. A closure according to claim 1 in which said mounting means comprises an indented channel formed in each side wall adjacent said floor, said slide including a bottom portion extending into said channel, said bottom portion having a width greater than the spacing of said sidewalls.

12. A closure according to claim 1 in which the length of slide is at least half the length of said slideway and said opening extends for no greater than one-half the length of said slideway.

13. A closure according to claim 1 including a recess in said cover member, said slideway being located in said recess.

14. A closure according to claim 1 including a ramp formed in each said sidewall at said indented portion, said ramps being opposite one another and being inclined upwardly from said floor.

15. A closure according to claim 1 including an approach leading to said facilitating means.

16. A closure according to claim 15 in which said approach comprises a sloped portion of said cover member adjacent and aligned with said facilitating means.

17. A closure according to claim 1 in which said attaching means comprises a flange extending about the periphery of said cover member.

18. A closure according to claim 17 in which said flange extends from a recess formed about the periphery of said cover member.

19. A closure for a container, comprising a. generally planar cover member, b. means for attaching said cover member to a container, c. a slideway formed in the cover member and extending generally from one edge thereof, said slideway extending at least a predetermined length and including i. spaced, parallel sidewalls, ii. a floor extending between said sidewalls, and iii. an opening in the floor to permit removal of the contents through the opening, d. a slide disposed in said slideway, said slide having a length less than said predetermined length, e. means mounting said slide in said slideway for sliding movement along the length of said slideway, said mounting means also retaining said slide in said slideway, f. means formed in said cover member for facilitating insertion of said slide within said sideway, and g. at least one detent in at least one of the sidewalls for temporarily positioning said slide at a desired location in said slideway, and a corresponding aligned protrusion on said slide.

20. A closure for a container, comprising a. generally planar cover member, b. means for attaching said cover member to a container, c. a slideway formed in the cover member and extending generally from one edge thereof, said slideway extending at least a predetermined length and including i. spaced, parallel sidewalls, ii. a floor extending between said sidewalls, and iii. an opening in the floor to permit removal of the contents through the opening, d. a slide disposed in said slideway, said slide having a length less than said predetermined length, e. means mounting said slide in said slideway for sliding movement along the length of said slideway, said mounting means also retaining said slide in said slideway, f. means formed in said cover member for facilitating insertion of said slide within said slideway, and g. a detent on said slide for temporarily positioning said slide at a desired location in said slideway, and at least one corresponding aligned protrusion in at least one of said sidewalls.

* * * * *